United States Patent [19]

McLaughlin et al.

[11] 4,304,455

[45] Dec. 8, 1981

[54] WATERPROOF ELECTRICAL CONNECTOR INCLUDING IMPROVED CORD GRIP

[75] Inventors: Emmett J. McLaughlin, Fairfield; Roy O. Wiley, Huntington, both of Conn.

[73] Assignee: Westinghouse Electric Corp., Pittsburgh, Pa.

[21] Appl. No.: 126,097

[22] Filed: Feb. 29, 1980

[51] Int. Cl.[3] ..... H01R 13/58

[52] U.S. Cl. ..... 339/103 M

[58] Field of Search ..... 339/103 R, 103 C, 60 R, 339/60 C, 94 C, 101, 107, 94 R, 94 M, 60 M, 103 M

[56] References Cited

U.S. PATENT DOCUMENTS

| | | | |
|---|---|---|---|
| 3,437,980 | 4/1969 | Smith | 339/103 R |
| 3,792,415 | 2/1974 | Hubbell | 339/60 R |
| 3,905,672 | 9/1975 | Anhalt | 339/103 R |
| 4,030,800 | 6/1977 | Vidoni et al. | 339/107 |
| 4,114,974 | 9/1978 | Lawrence | 339/103 C |

*Primary Examiner*—Joseph H. McGlynn
*Assistant Examiner*—John S. Brown
*Attorney, Agent, or Firm*—G. H. Telfer

[57] ABSTRACT

An electrical connector with weatherproofing and cord gripping qualities provided by a terminal housing having rearwardly projecting fingers that mate within recesses of a cap member, which recesses have tapered rear surfaces so that the fingers are forced inwardly radially to bear against a rubber bushing surrounding a contained conductor that has wire leads connected with contacts within the housing.

3 Claims, 4 Drawing Figures

WATERPROOF ELECTRICAL CONNECTOR INCLUDING IMPROVED CORD GRIP

BACKGROUND OF THE INVENTION

This invention relates to electrical connectors and more particularly to waterproof plugs and receptacles.

Connectors of the type to which the invention particularly relates are those in which electrical contacts are contained within an insulating housing, and joined with an external electrical conductor in a manner that permits the electrical terminations to be isolated from water, dust and the like. It is desirable also to have a cord grip so the assembled connector and conductor are not susceptible of damage or disassembly by reason of a pull on the conductor.

Various forms of connectors with cord grips or weatherproof features are heretofore known. For example, Smith U.S. Pat. No. 3,437,980, issued Apr. 8, 1979, illustrates a cord grip element of a plurality of fingers, which may be integrally formed with the contact housing, for gripping a conductor within a connector to insure its retention; Lawrence U.S. Pat. No. 4,114,974, issued Sept. 19, 1978 shows a connector having an annular sealing element extending around a cord that bears against the cord as it is assembled with a clamp element to bear against the sealing elements and the cord within. As additional background, reference is made to Bidoni et al. U.S. Pat. No. 4,030,800, issued June 21, 1977, illustrating another form of connector cap with cord grip and to Fuller U.S. Pat. No. 3,792,415, issued Feb. 12, 1974, which is representative of art in which a connector is provided with weatherproof qualities by the utilization of a rubber or other sealing element over its exterior.

While various forms of prior art devices are generally effective for their intended purposes, there remains interest in improvements in the design of connectors in order that they perform more reliably with long life while achieving the functions of a watertight and dustproof construction with positive retention of the conductor from pull-out, all of which is desirably to be in a configuration of relatively few and simple parts that can be quickly and simply assembled for overall economy.

SUMMARY OF THE INVENTION

In accordance with the present invention, a connector is provided including a terminal housing, a cap, and a sealing element of yieldable material such as rubber in a new and improved configuration. The terminal housing is of insulating material, preferably of molded plastic material, and contains a plurality of electrical contacts which may be either part of or related to the male prongs of a plug or the female contacts of a receptacle connector. The front of the connector is preferably of dead front design while the rear of the housing is the portion which is particularly improved in importance with this invention. Access is provided, for connecting wire leads of a conductor with the contacts within the housing, by one or more apertures for the entrance of a plurality of wire leads. The housing may have usual screw terminals or other forms of terminals for connection of the wire leads to the internal contacts. The housing also has a plurality of rearwardly projecting flexible fingers, preferably molded integrally therewith, that comprise part of the weatherproof cord connection means in accordance with this invention.

The cap is configured for securely fitting over the rear end of the terminal housing and has a central aperture permitting the sheathed conductor to extend therethrough. The inner surface of the cap is configured to provide a centrally located recess in which is fit a cylindrical rubber bushing or sealing element for fitting in close engagement with the conductor that passes through it. The cap also has a plurality of recesses that run alongside the location of the bushing and are open to the exterior surface of the bushing. These recesses each have a tapered end surface tapering toward the central aperture. The assembly of the cap with the housing after attachment of wire leads thereto results in the plurality of flexible fingers engaging the tapered end surfaces within the recesses of the cap so as to be forced into firm engagement with the bushing and the bushing in turn in firm engagement with a conductor extending therethrough. Additional means, such as screw fasteners, are provided for firmly retaining the terminal housing and cap together.

It is found that the connector as described is not only quite effective in providing the desired waterproof and dustproof qualities with assurance of positive cord retention but also that it is favorable in that the parts are relatively simple in their configuration, economical, and permit ease of formation and assembly. For example, since the rubber bushing is a simple cylindrical element, its location within the cap is permitted at any angular location and the assembly of the cap to the housing is achieved merely by placing the fingers of the housing within the recesses of the cap.

DESCRIPTION OF THE PREFERRED EMBODIMENTS

Figure 2:
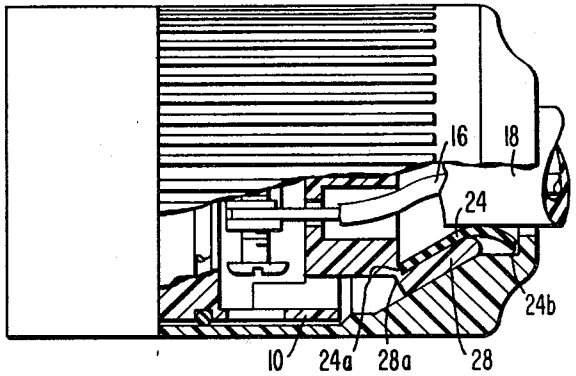
FIGS. 1 and 2 respectively illustrate disassembled and assembled perspective views of a connector in accordance with the present invention, FIG. 2 being partly broken away.
Figure 1:
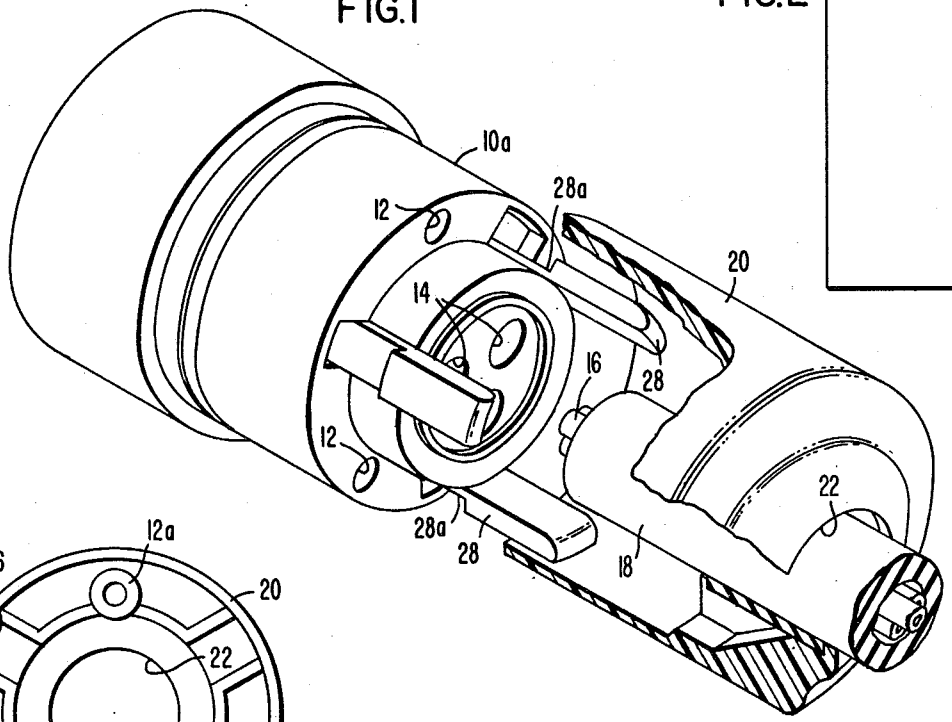

FIGS. 1 and 2 show a connector comprising an insulating terminal housing 10 including a housing body **10*a* containing a plurality of electrical contacts within it, but which are not illustrated here and a terminal cover 10*b*. The contacts may be of generally conventional form and are in this example those of a female receptacle connector element for receiving the prongs of a mating plug connector. The back end of the housing includes a set of apertures 12 for fasteners (not shown) that join the cap, to be described, and housing 10 as well as apertures 14 for receiving the wire elements 16 of a sheathed conductor 18 to be joined with the connector as shown in FIG. 2**.

Figure 4:
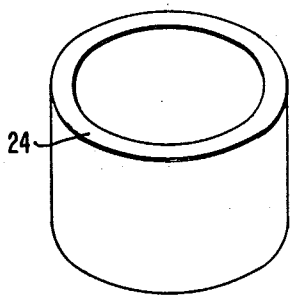
FIG. 4 illustrates a perspective view of the rubber bushing employed in the arrangement of FIGS. 1 and 2.
Figure 3:
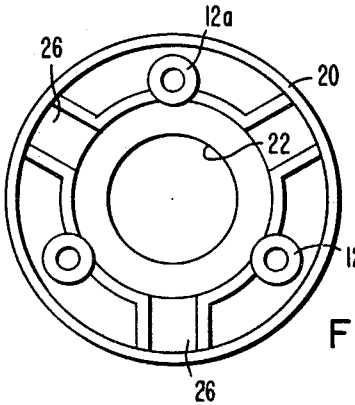
FIG. 3 shows an end view from within the cap of the device of FIGS. 1 and 2.

A cap 20, which is also shown in FIG. 3, is provided for fitting over the end of the housing 10 and running along its sides in close relation thereto with a central aperture 22 for receiving the cord 18. A simple cylindrical rubber bushing 24, also shown in FIG. 4, is located with the cap 20 and encircles the position of the sheathed conductor 18. Within the cap 20 there are also a plurality of recesses 26 that run alongside the bushing 24 and are open to the exterior surface of the bushing. These recesses each have a tapered end surface **26*a* tapering toward the central aperture 22**.

As part of the terminal housing 10 there is also included a plurality of flexible projecting fingers 28 extending toward the rear thereof that are received respectively within the recesses 26 of the cap and engage the tapered end surfaces 26*a* so as to be forced into firm engagement with the bushing 24 and the bushing in turn with the cord 18 extending therethrough. The assembled cap 20 and housing 10 are secured together by screw fasteners or some other means for which purpose the cap is provided with apertures 12*a* in alignment with apertures 12 of the housing.

It is preferred that the housing 10 and the cap 20 are each of molded plastic material, such as nylon or other high impact resistant material, and that the flexible fingers 28 are integrally with the remainder of the housing. This unit 10*b* and 28 is molded together and the thinness of the portion 28*a* at which the fingers are joined with the main part of the housing provides the necessary flexibility so that the bearing of the fingers against the tapered or cam surface 26*a* within the recesses 26 of the cap flexes them inwardly to bear securely against the bushing 24 and the conductor within it.

For simplicity of design the apertures 14 for receiving the wire leads of the conductor in the housing are in uniform spaced arrangement in the central portion thereof while the flexible fingers 28 are also in uniform spaced relation concentric with the circle of the wire lead apertures. Necessarily, the pattern of the recesses 26 within the cap matches that of the fingers of the housing.

In the event that any contamination enters between the cap 20 and the housing 10, it is prevented from penetrating to the electrical contacts within the housing by reason of the rubber bushing 24 which has one end face 24*a* fitting down tightly on the housing 10 and its rear end face 24*b* fitting against a shoulder 20*a* or a portion of the cap surrounding the central aperture 22. Additionally, pulling of the cord 18 does not result in separation or damage because of the firm securance of it by means of the flexible fingers 28 and the rubber bushing 24. In addition to restraining the wire leads 16 from pulling out of the device, this arrangement protects the conductor 18 from damage of wear or splitting at the points of restraint as is caused by some previous devices where finger elements of a cord grip arrangement bear directly against the conductor. Here, the rubber bushing provides a yielding but firm restraint on the conductor that does not subject it to surface wear or other damage.

Of course, the number and precise pattern of the recesses 26 and fingers 28 may be varied from the uniform arrangement of three as shown. However, three is found effective without need of additional numbers of such elements.

It is consequently believed that the present invention provides a design for a connector that achieves the multiple purposes of reliability and performance including weatherproofing and cord retention in an arrangement that is simple and economical to form and assemble. Various changes and modifications may be made from the specific embodiment disclosed while retaining the essential features of the invention.

We claim:

1. A weatherproof electrical connector comprising: a terminal housing containing a plurality of electrical contacts; means for connecting wire leads of a sheathed conductor with said contacts; a cap for securely fitting over the rear end of said terminal housing that receives the sheathed conductor, said cap having a central aperture permitting the sheathed conductor to extend therethrough; a cylindrical rubber bushing located within said cap and encircling the position of the sheathed conductor; said cap having a plurality of recesses that run alongside said bushing and are open to the exterior surface of said bushing, said recesses each having a tapered end surface tapering toward said central aperture; said terminal housing also including a plurality of projecting flexible fingers extending toward the rear thereof that are received respectively within said recesses and engage said tapered end surfaces to be forced into firm engagement with said bushing and said bushing in turn with a conductor extending therethrough; and means for securing said terminal housing and said cap together.

2. A waterproof electrical connector in accordance with claim 1 wherein: said housing and said cap are each of molded plastic material and said flexible fingers are integrally joined with the remainder of said housing by a thin section of molded plastic material.

3. A weatherproof electrical connector in accordance with claim 2 wherein: said cap recesses are arranged in uniform spaced relation about the location of said central aperture and said flexible fingers of said housing mate therewith.

* * * * *